United States Patent [19]

Frey et al.

[11] 4,090,756

[45] May 23, 1978

[54] RECESSED PULL FOR MOVABLE PANELS

[75] Inventors: Frederick J. Frey, Michigan City, Ind.; William F. Chandler, Jamestown, N.Y.

[73] Assignee: InterRoyal Corporation, New York, N.Y.

[21] Appl. No.: 679,965

[22] Filed: Apr. 26, 1976

[51] Int. Cl.[2] ..... A47B 95/02

[52] U.S. Cl. ..... 312/320; 312/330 R; 312/234.4; 16/124

[58] Field of Search ..... 312/320, 330, 204, 296, 312/234.1, 234.5; 16/124, 110, 110.5, 114

[56] References Cited

U.S. PATENT DOCUMENTS

| | | | |
|---|---|---|---|
| 3,117,339 | 1/1964 | Vigna | 312/320 |
| 3,218,112 | 11/1965 | Stark | 312/320 |
| 3,238,656 | 3/1966 | Kanzelberger | 312/234.4 |
| 3,239,298 | 3/1966 | McCarthy | 312/234.3 |
| 3,252,746 | 5/1966 | Kafferlin et al. | 312/320 |
| 3,514,904 | 6/1970 | Riegelman | 16/114 R |
| 3,742,554 | 7/1973 | Houtman | 16/124 |
| 3,775,808 | 12/1973 | Little | 16/124 |
| 3,932,010 | 1/1976 | Kenworthy | 312/320 |
| 3,969,009 | 7/1976 | Rader | 16/124 |

FOREIGN PATENT DOCUMENTS

| | | | |
|---|---|---|---|
| 568,243 | 12/1958 | Canada | 312/234.3 |
| 1,190,619 | 4/1965 | Germany | 312/320 |
| 694,795 | 9/1965 | Italy | 312/234.4 |

*Primary Examiner*—Robert L. Wolfe

*Assistant Examiner*—Victor N. Sakran

*Attorney, Agent, or Firm*—Arthur A. March

[57] ABSTRACT

A recessed pull is provided for movable panels such as the front panel of a file cabinet, desk drawer or the like in which the front panel has an aperture intermediate its sides, a trim piece having a groove along its upper and lower edges can be snap-fit into the aperture with the edges of the panel around the aperture engageable in the grooves in the trim piece, and the trim piece has beveled portions along the sides of the upper or bottom edge at the rear of the trim piece so that it will slowly deform under pressure when inserted into the aperture and return to normal shape and size upon engagement of the edges of the aperture in the grooves of the trim piece. A cover element having rear, top, bottom and side walls is provided with a downwardly extending flange from the top wall which engages in the groove along the upper edge of the trim piece in back of the edge of the aperture also accommodated within said groove. The cover element is provided with an integral plate extending downwardly from the front of its bottom wall and at the end of said plate it is bent upon itself to provide a channel. A stiffener is inserted in said channel whose weight causes the flange at the top of the cover member to be maintained in the groove along the edge of the trim piece and to provide reinforcement inhibiting buckling of the front panel. The edges of the front panel around the aperture are embossed or offset whereby the front of the trim piece is flush with the remainder of the wall of the front panel.

5 Claims, 5 Drawing Figures

RECESSED PULL FOR MOVABLE PANELS

BACKGROUND OF THE INVENTION

There have been many proposals for providing recessed pulls for movable panels such as the front panel of a file cabinet desk drawer or the like in place of the unattractive, costly and difficult to assemble outwardly extending pulls.

Many proposals have been offered including those in which an aperture is cut into the front panel which aperture is concealed by a yieldable spring member as shown in U.S. Pat. No. 3,098,686. Other and later proposals have been made for providing an aperture in the aforesaid front panels for file cabinets and desk drawers and for concealing the file or drawer behind said aperture by various means. One such proposal has been the provision of a box-like element carried at the rear of the aperture by a mutually supportable frictional engagement with a trim piece surrounding the inner and outer edges of the aperture as shown in U.S. Pat. No. 3,742,554. In this construction the trim piece and the box-like element slidably engage each other.

The foregoing structures in some instances presented a reasonably neat and attractive edging around the aperture in the face of the panel or drawer front. However, they are relatively difficult to assemble and costly to construct because, for example, of the necessity for providing the box-like element with rails of a particular dimension and shape to slide onto the tracks in the interengaging trim piece. Furthermore, the proposed structures necessarily presented an outwardly extending trim piece which was not flush with the surface of the panel surrounding the aperture so that a ledge or ridge was formed around the aperture. Consequently, there are possibilities of damage to the hand of the user or engagement with the clothing of a passerby who might come into inadvertent contact with the relatively sharp edges of the trim member. In addition, in such recessed pull structures no means were provided to prevent inadvertent buckling of the panel or drawer front under certain conditions.

SUMMARY OF THE INVENTION

The present invention overcomes the difficulties of prior structures in the provision of a recessed pull for files and drawers or the like which presents an attractive trim assembly around the aperture of the front panel without the requirement for any interlocking sliding engagement with a supporting rear box-like member. In addition, the recessed pull assembly is such that the outer surface of the pull is substantially flush with the outer surface of the panel itself. Furthermore, the present construction accommodates a stiffener element which inhibits the buckling of the front panel.

In accordance with the present invention, an aperture of any desirable dimension is first cut out of the front panel of a file cabinet or desk drawer or the like. A trim piece is inserted into this panel in a simple snap-fit fastening arrangement. To accomplish this result, the outer perimeter of the aperture serves as the means which interlock with the trim piece by engaging in a slot extending intermediate the upper and lower edges of the trim piece. The trim piece is so constructed that it may be easily manually or mechanically inserted into the aperture with the outer perimeter or face of the trim piece covering the outside of the aperture and the slots accommodating and engaging with the upper and lower edges of the panel around the aperture to provide a friction fit therebetween.

The trim piece is inserted into the aperture by a simple pressing manipulation which ever so slightly compresses the horizontal edges of the trim piece to thereby locate the upper and lower edges of the panel surrounding the aperture in the slots in the trim piece. When so located, the trim piece automatically returns to its original shape and is locked in position. Thus, a snap-lock arrangement is accomplished to facilitate the original assembly of the trim piece around the aperture in the front panel of the file or drawer.

A covering member having rear, top, bottom and side walls and an open front is then placed rearwardly of the aperture to form a cavity. A lip or flange extends downwardly from the front portion of the upper wall of the covering member and is located in the slot along the upper portion of the trim piece. The construction of the assembly is such that the flange is disposed in said slot between the rear wall of the panel surrounding the aperture and the rear edge of the trim piece adjacent to the slot. Thus, the covering member is carried, somewhat frictionally, and the aperture in the panel is thereby covered by the rear, top and side walls of the covering member to form an attractive recessed pull.

Depending from the bottom wall of the covering member is an L-shaped plate which may be formed integral with the covering member in any simple machine forming operation. The downwardly extending portion of the L-shaped section is preferably disposed adjacent to the rear wall of the front panel of the file cabinet or drawer below the aperture. The base of the L-shaped member is formed into an inwardly extending shelf which terminates in an upwardly extending flange portion to provide a channel. A stiffening element is frictionally carried by and supported in this aforesaid channel. The stiffener, which may be relatively elongate, can comprise a solid block of material or a simple U-shaped element and extends substantially the length of the channel. The stiffener serves to maintain the downwardly depending portion of the L-shaped member against the rear of the front panel of the file or drawer. The aforesaid construction and arrangement of the stiffener also serves to inhibit any buckling of the panel as might occur under abusive use. In addition, the stiffener assists in maintaining the covering member in position at the rear of the aperture with the flange or lip depending from the upper wall of the covering member firmly engaged within the slot on the upper portion of the trim piece. As a consequence, a positive lock is obtained which prevents the covering member from inadvertent movement.

As an added advantage, the foregoing structure permits an interfitting and interlocking arrangement with an embossed or offset portion of the panel surrounding the aperture. When the panel is so embossed or offset, the trim piece may be accommodated in such fashion that its front surface is flush with the surface of the panel itself with the resultant extremely attractive appearance and safe non-damaging arrangement.

DETAILED DESCRIPTION OF THE INVENTION

Figure 1:
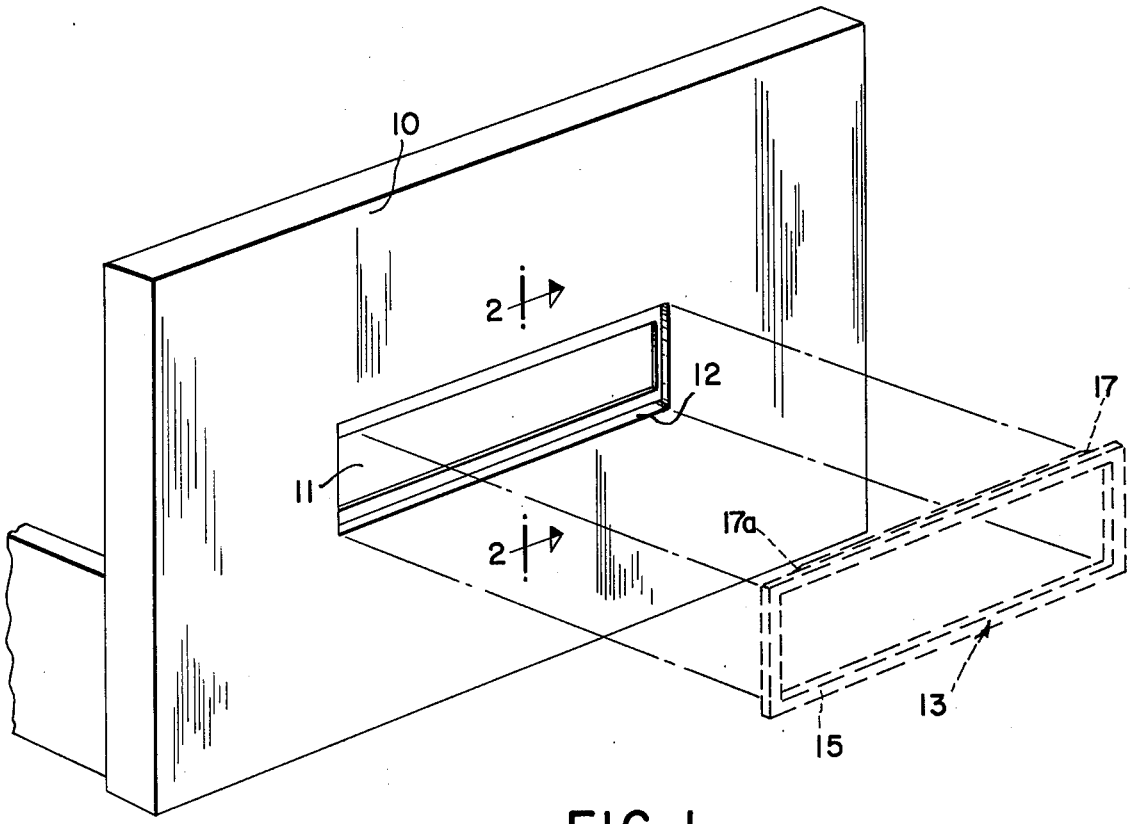
FIG. 1 is a perspective view of the front panel of a file cabinet or the like with recessed pull of the present invention in position and showing, in dotted lines, various elements of the recessed pull disposed to the rear of the panel.
Figure 2:
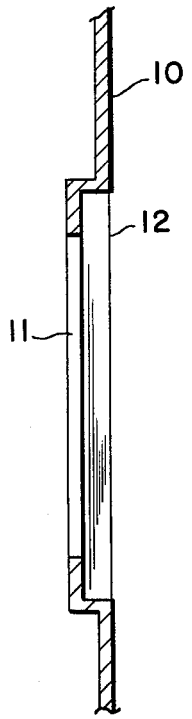
FIG. 2 is a section taken along the lines 2—2 of FIG. 1.
Figure 3:
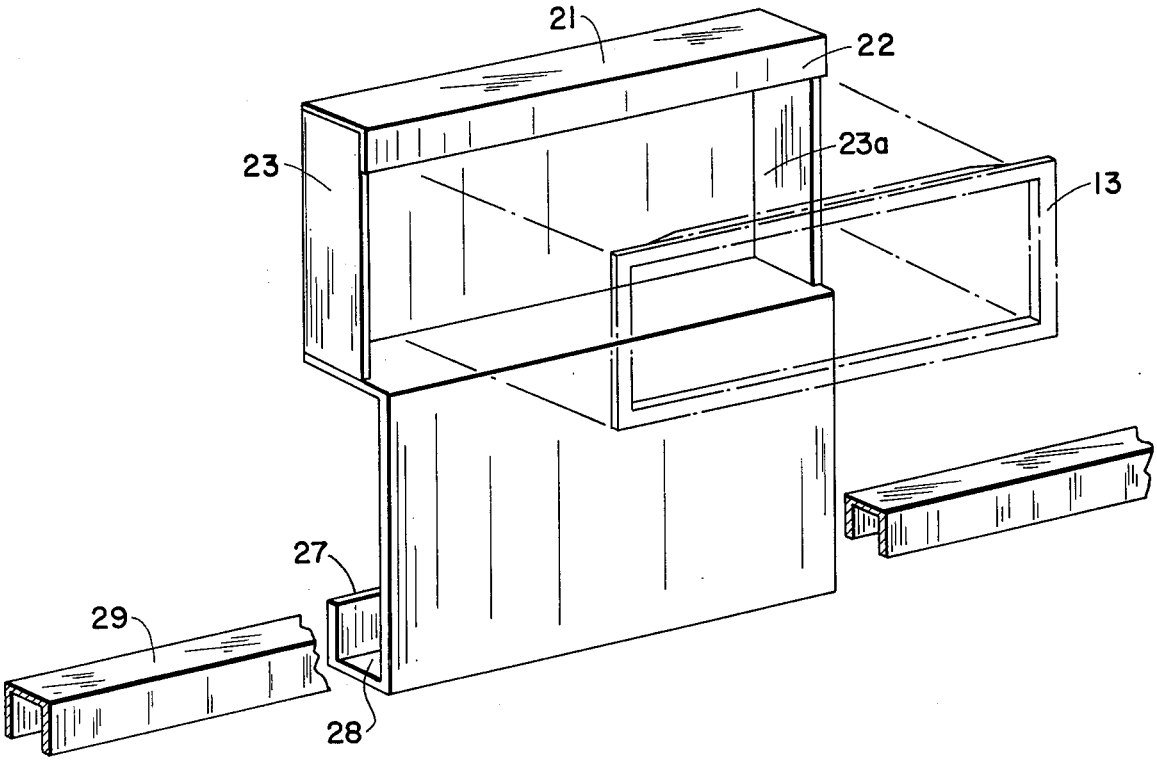
FIG. 3 is an exploded perspective view separately showing the cover member, trim piece and stiffener.
Figure 4:
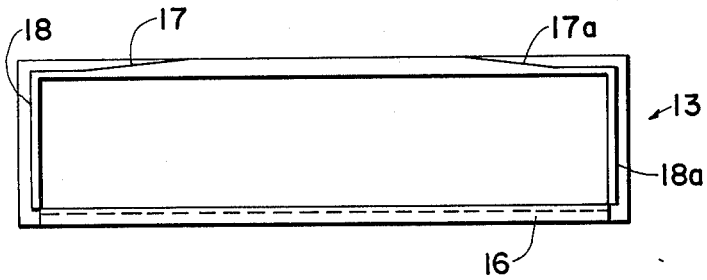
FIG. 4 is a rear view of the trim piece of the present invention.
Figure 5:
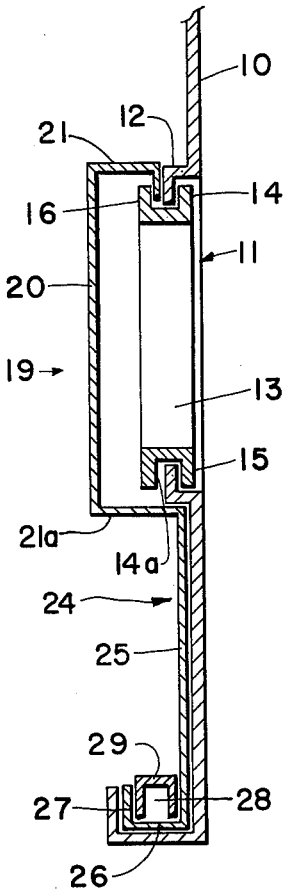
FIG. 5 is a sectional view showing the interengaging relation between the trim piece, the front panel of the file and the cover member.

The following description of the present invention is provided in some detail to facilitate a complete understanding thereof but is not to be construed as any limitation upon the scope thereof. As is shown in the drawing, the front panel 10 of a file cabinet or desk drawer or the like is provided with an aperture 11. The aperture is preferably rectangular in shape in accordance with present day practice, however, the specific shape may vary. Also, as illustrated, the edge of the front panel 12 surrounding the aperture 11 is preferably embossed or rearwardly offset for the purposes hereinafter described.

A trim piece 13 is provided of substantially the same size and shape as the aperture 11. The trim piece may comprise a metal casting which is provided with slots 14 and 14*a* intermediate the front and rear surfaces of the upper and lower edges of the trim piece casting. While the trim piece has been described as a metal casting, it may, of course, be of any suitable material having the desired properties such as plastic or the like. The trim piece 13 is relatively rigid but nevertheless, with a modicum of resiliency enabling it to slightly flex and being possessed of a "memory" sufficient to return the piece to the original shape without any permanent deformity whatsoever. The slots or grooves 14 and 14*a* divide the trim piece into a front surface 15 and rear surface 16. The upper or lower rear surface 16 is provided near each side edge with beveled portions 17 and 17*a* which materially aid in the flexing and return to original shape of the trim piece as in hereinafter described in connection with the assembly of the members. As shown, slots are not required in the side edges walls 18 and 18*a* of the trim piece although, as shown, the front surface 15 of the trim piece is of a wider dimension than the aforesaid side walls in order to cover and completely surround the edge of the aperture 11. As aforesaid, the trim piece is preferably relatively narrow, streamlined and of an attractive dimension which blends into the front of the file cabinet and adds greatly to the attractiveness thereof.

In accordance with the invention, a cover member 19 is provided. The cover member comprises a rear wall 20, a top wall 21 and a bottom wall 21*a*. The top wall is provided with a lip or flange 22 depending from the forward edge of the top wall 21. Furthermore, the cover member has side walls 23 and 23*a* which, as illustrated, completely enclose the rear of the aperture 11 in the front panel 10. As shown, the front of the cover member is open so that the aperture is in no way blocked from access by persons using the file.

The cover member in accordance with the present invention, is preferably provided with an extension 24 which depends from the forward edge of the bottom wall 21*a*. The extension 24 comprises a plate-like member or plate 25 and extends along the rear side of the front panel. Near one extremity of the plate 25, it is bent upon itself to form the base or ledge portion 26 the end of which is bent upwardly to form a flange 27, as shown. The depending extension 24 is thus substantially L-shaped forming a channel 28 between the bottom of the plate 25 and the flange 27.

A stiffening element 29 is provided of a sufficient dimension to be accommodated within the channel 28. As shown, the stiffener 29 is a U-shaped member although it may comprise a solid block or bar or any other construction fitting within the channel for the purposes hereinafter setforth.

In assembling the recessed pull of the present invention, it is preliminarily only necessary to provide a suitable aperture 11 in the front panel of the filing cabinet or desk drawer. A trim piece 13 is then inserted into the aperture with the rear surface 16 having the beveled edge portions 17 and 17*a* extending into the file cabinet and the rear of the front panel. The trim piece is so constructed that a modest amount of pressure will cause the upper or lower surface having the beveled edge portion to flex inwardly so that it will pass through the upper and lower edges of the aperture 11 and will return to normal shape and form when the edges of the aperture engage in the grooves or slots 14 and 14*a*. The trim piece is then in position with the front surface 15 surrounding the entire edge 12 of the aperture 11.

As illustrated, the edge 12 may be embossed or offset to an extent whereby the front surface 15 of the trim piece surrounding the embossed edge 12 is flush with the remainder of the front of the panel. This construction provides a highly desirable and attractive outer appearance for the front panel itself and eliminates the presenting of any exposed edges around the front of the trim piece 13.

Thereafter, the cover member 19 is placed with its open front face adjacent to the rear of the aperture 11 in the front panel member 10. The lip or flange 22 depending from the front edge of the top wall 21 of the cover member is inserted into the upper groove or slot 14 in the top of the trim piece 13. Thus, a recessed pull is formed by this structure which may be secured together without any intersliding or other type of frictional engagement in which prior structure each piece of the recessed pull is maintained in position solely by its contact with another element of the recessed pull. As shown, the present invention provides a trim piece 13 which is self-supporting and surrounds the edge without any further assistance because of its unique construction and the consequent ability to insert into position and maintain it without reliance upon any other means. The cover is then placed in position depending from and supported in the slot 14 in the trim piece 13.

The recessed pull of the present invention is, in addition, provided with a unique feature having a dual function. As illustrated, an extension 24 comprising plate 25 depends from the forward edge of the bottom wall 21*a* extending downwardly along the rear side of the front panel. The end of the plate 25 has a channel 28 which may be accomplished by bending the plate upon itself, as shown. In accordance with the present invention, a stiffening element of any suitable construction having some weight is placed within the channel and, as one of its functions, urges the cover member downwardly thereby pressing the lip or flange 22 into locking engagement within the slot 14 in the top of the trim piece 13. In addition, the stiffener function as the means for preventing buckling of the thin metal material which may comprise the front panel 10. In the absence of this stiffening element, buckling can occur under any inadvertent pressure such as an attempt to open the front panel when it is locked in position by any usual locking means (not shown). The stiffener adds to the strength of the front panel and prevents any such inadvertent damage.

As a result of the unique structure presented by the combination of elements of the recessed pull, an attractive, easy to assemble and relatively inexpensive arrangement is provided. There are no unnecessarily exposed edges around the trim piece which is flush with the remainder of the panel surrounding the aperture intermediate the edges of the panel.

The specific description and illustration of the present invention is merely to illustrate an embodiment accomplishing the unique advantages of the present invention. The description does not, in any way, limit the scope of the invention as defined in the appended claims.

We claim:

1. A pull for a movable panel having an aperture comprising:

a unitary trim piece for surrounding said aperture having grooves along its upper and lower edges adapted to accommodate the upper and lower edges of the panel around the aperture, yielding edge means intermediately disposed integrally on the trim piece and comprising an intermediately extending beveled portion along at least one of the said edges of the trim piece and defining the corresponding portion of the groove thereat for enabling the trim piece to be deformed locally thereat in a direction substantially crosswise of the normal plane of said beveled portion under pressure laterally thereagainst and to return to its original shape upon the release of said pressure whereby the trim piece may be pressed thereat against an adjacent edge portion of the panel around the aperture and into self-supporting position into the aperture with the upper and lower edges of the panel around the aperture accommodated in the grooves along the upper and lower edges of the trim piece upon the release of said pressure and return of the trim piece to its original shape for snap-locking the unitary trim piece into the panel aperture, a cover member having rear, top and bottom walls and a flange downwardly extending from one top wall of the cover member engageable in the groove along the upper edge of the trim piece, and weight means for exerting downward pressure on the flange of the coven member to maintain said flange in said groove in the trim piece to inhibit inadvertent disengagement of the cover member from the trim piece.

2. A pull according to claim 1 wherein the weight means comprise a plate downwardly extending from the bottom wall of the cover member and adapted to extend adjacent the rear face of the movable panel, and a channel member formed at the lower end portion of the downwardly extending plate, and a stiffening element is carried within said channel member and adapted to extend along the rear of the movable panel to inhibit buckling of such panel under exertive forces.

3. A movable front panel for a file cabinet or the like having an aperture in said panel, a trim piece having grooves extending between the front and rear surfaces of said trim piece along the upper and lower edges thereof, said grooves engaging the upper and lower edges around the aperture in said panel, said edges of the panel around said aperture being rearwardly offset whereby the front surface of the trim piece is flush with the surface of the panel adjacent to such offset edges, a cover member having rear, top and bottom walls and a flange downwardly extending from the top wall of the cover member and engaged in the groove along the upper edge of the trim piece, and weight means in engagement with the cover member for exerting downward pressure on the flange of the cover member to maintain said flange in said groove in the trim piece to inhibit inadvertent disengagement of the cover member from the trim piece.

4. A movable front panel according to claim 3 wherein the weight means comprise a plate downwardly extending from the bottom wall of the cover member and extending adjacent the rear face of the movable panel, and a channel member formed at the lower end portion of the downwardly extending plate, said plate and channel member being integral with said rear, top and bottom walls of the cover member, and a stiffening element is carried within said channel member and extends along the rear of the movable panel to inhibit buckling of such panel under exertive forces.

5. A movable front panel according to claim 3 for a file cabinet or the like having an aperture in said panel, a unitary trim piece surrounding said aperture and having grooves extending between the front and rear surfaces of such trim piece along the upper and lower edges thereof, said grooves engaging the upper and lower edges in said panel around the aperture, said edges of the panel around said aperture being rearwardly offset whereby the front surface of the trim piece is flush with the surface of the panel adjacent to such offset edges, yielding rear edge means intermediately disposed integrally on the trim piece and comprising an intermediately extending beveled rear wall portion along one of said edges of the trim piece and defining the corresponding portion of the groove thereat for enabling the trim piece to be deformed locally thereat in a direction substantially crosswise of the normal plane of said beveled portion under pressure laterally thereagainst and to return to its original shape upon the release of said pressure whereby the trim piece pressed thereat against the adjacent edge portion of the front face of the panel around the aperture is disposed into self-supporting position in the aperture with the upper and lower edges of the panel around the aperture accommodated in the grooves along the upper and lower edges of the trim piece upon release of said pressure and return of the trim piece to its original shape and thereby placed in snap-locking relation with the panel aperture, a cover member having rear, top and bottom walls and a flange downwardly extending from the top wall of the cover member and engaged in the groove along the upper edge of the trim piece rearwardly of the rear face of the panel, a plate downwardly extending from the bottom wall of the cover member and extending adjacent the rear face of the panel for exerting downward pressure on the flange of the cover member to maintain said flange in said groove in the trim piece to inhibit inadvertent disengagement of the cover member from the trim piece, a channel member formed at the lower end portion of the downwardly extending plate, and a stiffening element carried within said channel member and extending along the rear of the panel to inhibit buckling of such panel under exertive forces.

* * * * *